United States Patent [19]

Mazzorana

[11] 4,154,117

[45] May 15, 1979

[54] STARTER FOR INTERNAL COMBUSTION ENGINES

[75] Inventor: Alfred B. Mazzorana, Venissieux, France

[73] Assignee: Societe de Paris et du Rhone, Lyons, France

[21] Appl. No.: 859,892

[22] Filed: Dec. 12, 1977

[30] Foreign Application Priority Data

Dec. 22, 1976 [FR] France ..... 76 39213

[51] Int. Cl.[2] ..... F02N 15/06

[52] U.S. Cl. ..... 74/7 A

[58] Field of Search ..... 74/6, 7 R, 7 A

[56] References Cited

U.S. PATENT DOCUMENTS 3,020,771 2/1962 Redick et al. ..... 74/7 A 3,280,811 10/1966 Baker et al. ..... 74/6 X

FOREIGN PATENT DOCUMENTS 939846 3/1956 Fed. Rep. of Germany ..... 74/7 A 2045224 2/1971 France.

*Primary Examiner*—Allan D. Herrmann

*Attorney, Agent, or Firm*—Dowell and Dowell

[57] ABSTRACT

In order to hold the shaft of a starter motor against undue movement or whipping as a result of vibration communicated to it by the engine with which it is associated, the drive pinion assembly on the shaft is held steady by forming on it a conical surface which, when the starter is not operating, fits into a conical surface formed on a member which is fixed in position intermediate the ends of the drive shaft.

The member may be a plate-like member with an opening lying at the bottom of a conical depression. It may be gripped between the yoke of the field magnet and the nose casing of the starter and may have locating means for positioning the yoke. Where a solenoid is used the member may carry a block forming a seal between the yoke and the solenoid casing, or it may be constructed to be gripped between the solenoid casing and the nose portion.

13 Claims, 3 Drawing Figures

STARTER FOR INTERNAL COMBUSTION ENGINES

FIELD OF THE INVENTION

The present invention relates to improvements made to electric starters for internal combustion engines.

BACKGROUND OF THE INVENTION

It is known that outside the actual working periods of a starter of this kind its shaft is subjected to considerable vibration communicated to it by the engine with which it is associated.

In order to avoid the fracture of the shaft in question two methods are employed. The first consists in using a very rigid shaft of which the natural vibration frequency is outside the frequencies of the range of utilisation. The other solution provides for the shaft an intermediate bearing fastened to the yoke of the starter.

When a starter is constructed in accordance with the first solution, only radial vibrations of the shaft are limited by the stiffening of the shaft. With the second solution the amplitude of deformation of the shaft is limited to a greater extent, but the drive pinion assembly then behaves like an independent vibrating mass, so that there is premature wear of the grooves or splines of the shaft and drive pinion assembly.

SUMMARY OF THE INVENTION

The present invention seeks to obviate or reduce the above disadvantages in a simple way and at a minimum of extra cost. Indeed it has been found that starters of the present invention can be made more economically than some of the designs hitherto employed.

The present invention consists in providing a male conical surface on the drive pinion assembly of the starter and in locating intermediate of the ends of the motor shaft a member which is stationary, i.e. fixed in position in relation to the non-moving parts of the starter such as a housing or the yoke of the field magnet, there being a female conical surface on the said member into which fits the male conical surface on the drive pinion assembly when this is in its rest position.

The stationary member may be a plate-like member having a conical depression with an opening at the bottom of the depression through which the motor shaft passes. When the starter is energised and the drive pinion assembly moves into its active position, the conical surface on the drive pinion assembly moves out of contact with the plate-like member, and the motor shaft can rotate freely. The plate-like member may thus be termed a false bearing, as it holds the drive pinion assembly only when this is stationary.

The stationary member may be provided with locating means which cooperate with the yoke and a casing forming the nose portion of the starter to position the yoke correctly in relation to the nose portion. The locating means may comprise portions pressed out from the plate forming the said member. It is thus possible to make a flat joint between the elements in question so as to reduce considerably the cost of machining.

Where the design of starter utilises a solenoid with a shift lever between the solenoid and the drive pinion assembly, the stationary member may bear an abutment to act as fulcrum for the lever and may also hold a block which forms a seal between the yoke and the solenoid casing. A plate-like stationary member may have the external shape of the profile of the solenoid casing, so that the member will also be gripped between the said casing and the nose of the starter.

BRIEF DESCRIPTION OF THE DRAWINGS

Further features which the starter of the invention may embody will be clear from the following description, given by way of example, of the forms of the invention illustrated in the accompanying drawings, in which.

DESCRIPTION OF THE PREFERRED EMBODIMENTS

Figure 1:
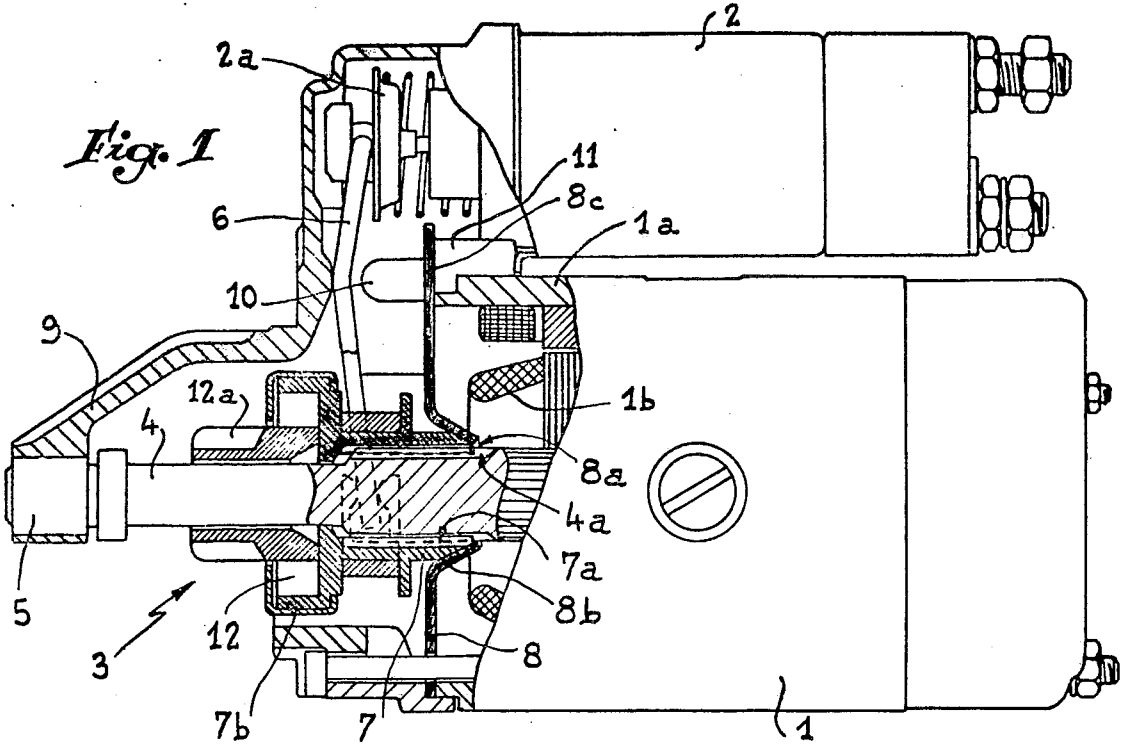
FIG. 1 is an external view, partly broken away and partly in section, of an electric starter according to the invention.

The starter of FIG. 1 comprises an electric motor 1, a solenoid 2, and a drive pinion assembly 3 mounted for sliding on the motor shaft 4. In a manner known per se the drive pinion assembly 3 is movable from its rest position illustrated towards the left into its active position, that is to say in the direction of a bearing 5 mounted in a casing forming a nose portion 9, by means of a forked shift lever 6 of which one end is associated with the movable part 2*a* of the solenoid 2, while its opposite end embraces the drive pinion assembly 3. The lever 6 is spring-loaded into the position shown, but moves the drive pinion assembly 3 into its active position when the part 2*a* is attracted to the right on energisation of the solenoid.

The free end of the driver 7 of the drive pinion assembly 3 is frustoconical, an intermediate member 8 in the form of a plate being positioned at the junction between the yoke 1*a* of the motor and the nose portion 9 of the starter. This plate-like member 8 is provided with an opening 8*a* through which the shaft 4 passes and which is situated at the bottom of a conical depression constituting an abutment 8*b* for the driver 7 when the latter is at rest. The abutment 8*b* is so disposed that the drive pinion assembly 3 is situated as close as possible to the armature 1*b* of the motor 1, so as to provide for an adequate length of movement between the active and rest positions. The member 8 is rigidly fixed to the yoke 1*a*, and its depression or abutment 8*b* constitutes an intermediate false bearing for the shaft 4 which, outside periods of operation of the starter, is held radially at that point with the aid of the driver 7, but which freely rotates out of contact with the member 8 when the drive pinion assembly has moved to its active position. Because of the conical shape of the free end of the driver 7 and of the abutment 8*b*, and because of the action of the lever 6 holding these two parts abutting, it may be considered that the drive pinion assembly is fixed in relation to the yoke 1*a*in its rest position. The amplitudes of vibration of the shaft 4 are therefore limited to the play that may exist between the splines 4*a*, 7*a* of the shaft and the driver respectively.

The member 8 is provided with an extension or lug 8*c* which projects beyond the periphery of the yoke 1*a* to a point just below the solenoid 2. The front face of the lug 8*c*, that is to say the face which is towards the nose portion 9 of the starter, is provided with an abutment 10 against which the lever 6 is fulcrumed when the solenoid 2 is energised. The opposite face of the lug 8*c* carries a block 11 made of a relatively flexible material, which provides a cushioned seal between the yoke 1*a* and the casing of the solenoid 2. The driver 7 is preferably made from an extruded steel blank and provides, at the end remote from the abutment 8*b*, a cage 7*b* which houses the usual freewheel mechanism 12 through which is driven a pinion 12*a* freely mounted for rotation over the shaft 4. When the starter is fitted to an internal combustion engine and the drive pinion assembly 3 is moved into active position, the pinion 12*a* meshes with the flywheel of the engine. The freewheel mechanism ensures a positive drive of the pinion 12*a* until, on the starting of the internal combustion engine, the pinion starts to move at a greater rate than the rest of the drive pinion assembly, at which point the freewheel mechanism prevents the pinion 12*a* driving the rest of the assembly. The splines 7*a* in the driver can be formed during the extrusion, whether they are helicoidal or straight. They could alternatively be formed on the otherwise completed driver.

Figure 2:
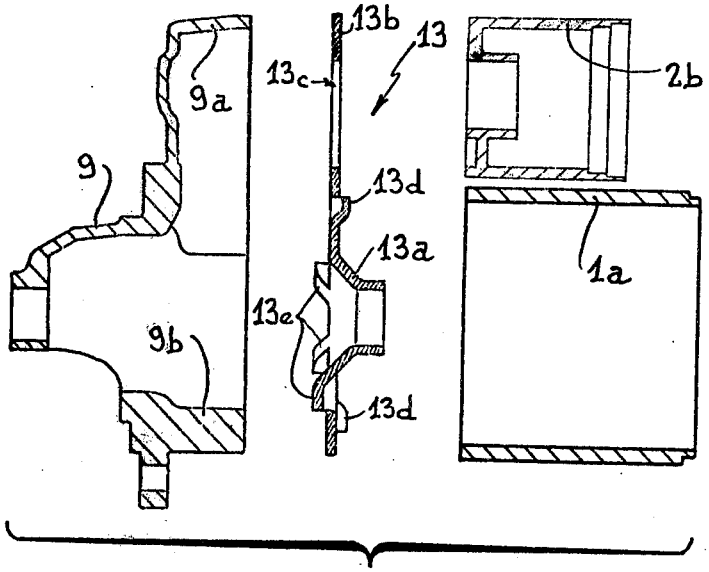
FIG. 2 is an exploded view showing an alternative form of stationary member from that shown in FIG. 1 and also the parts between which it is gripped.
Figure 3:
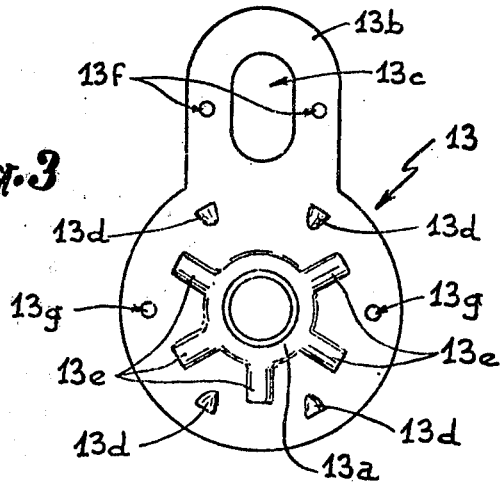
FIG. 3 is a view of the stationary member in elevation.

According to a modified embodiment of the invention shown in FIG. 2 the plate-like member 13 which provides the false bearing is gripped between the nose 9 on the one hand and the yoke 1*a* and the casing of the solenoid 2 on the other. In this embodiment the opposed faces of the above-mentioned elements are plane so as to reduce the cost of machining, the usual inter-engagement shown at the lower end of FIG. 1 being eliminated. The conical depression 13*a* of the member 13 corresponds to that of the member 8 of the previously mentioned embodiment. The member 13 is provided with an upwardly extending lug 13*b* (FIGS. 2 and 3), which has a shape corresponding to the outside shape of the casing 2*b* and to the facing portion 9*a* of the nose 9, so that this lug can be gripped between the mutually facing portions of these two elements. An opening 13*c* is provided in the lug 13*b* to permit the passage of the movable unit of the solenoid 2. The references 13*f* and 13*g* are given to the holes by which the connecting ties (not shown) pass respectively through the lug 13*b* and the main part of the member 13.

In order to enable the yoke to be centred in relation to the nose 9, locating means in the form of projections 13*d* and 13*e*, directed respectively towards the yoke and the nose, are provided in the member 13 around the depression 13*a*. These projections are preferably produced alternately by pressing portions out of the member 13. A series of projections 13*d* are thus obtained, which are directed towards the yoke 1*a* and which fit with functional clearance within the bore in the said yoke, while the series of projections 13*e* fit within the bore 9*b* formed in the nose 9.

It will readily be understood that the action of the connecting ties (not shown), which enable the corresponding faces of the yoke and nose to be held together, presses these parts against the plate-like member 13 with pressure such that sealing at this point is achieved by this action alone. Sealing can optionally be improved by providing the member 13 with a coating, for example of suitable plastics material.

Provision could also be made to form projections in the lug 13*b* of the member 13, in order to achieve centring of the casing 2*b* of the solenoid 2 in relation to the nose 9, but because of the construction of the starter this centring of the casing 2*b* is not necessary.

With the aid of the present invention a starter has thus been obtained whose shaft is held against whipping under the influence of vibrations.

What is claimed is:

1. In an electric starter for an internal combustion engine having a field magnet, a yoke for the field magnet, a motor shaft and a drive pinion assembly on the motor shaft movable between active and rest positions thereon, the improvement which consists in providing a male conical surface on the drive pinion assembly, a member intermediate the ends of the motor shaft which is fixed in position relative to the said yoke and a female conical surface on the said member into which fits the male conical surface on the drive pinion assembly when this is in its rest position.

2. An electric starter according to claim 1 wherein the said member is a plate-like member having a conical depression with an opening at the bottom of the depression through which the motor shaft passes.

3. An electric starter according to claim 1 wherein the said member is held in position against the yoke for the field magnet.

4. An electric starter according to claim 3 having a solenoid housed in a casing adjacent the said yoke and a shift lever operatively connected between the solenoid and the pinion, the said member bearing an abutment for the shift lever and a block which forms a seal between the yoke and the solenoid casing.

5. An electric starter according to claim 1 having a casing forming a nose portion, the said member being in the form of a plate gripped between the yoke for the field magnet and the said nose portion.

6. An electric starter according to claim 1 wherein the drive pinion assembly comprises a pinion, a freewheel drive for the pinion, a cage round the drive and an internally splined sleeve which engages splines on the motor shaft, the cage and the splined sleeve being made as one piece, and the conical surface being provided at the end of the splined sleeve.

7. An electric starter according to claim 5 wherein the said member is provided with locating means which cooperate with the yoke and the nose portion to position the yoke correctly in relation to the nose portion.

8. An electric starter according to claim 7 wherein the locating means comprise portions pressed out from the plate.

9. An electric starter according to claim 5 wherein the yoke and the nose portion have mutually facing faces which are plane.

10. An electric starter according to claim 5 having a solenoid housed in a casing adjacent the said yoke wherein the member is also gripped between the solenoid casing and the nose portion.

11. An electric starter according to claim 10 wherein the solenoid casing and the nose portion have mutually facing faces which are plane.

12. An electric starter for an internal combustion engine having a solenoid, a casing housing the solenoid, a field magnet, a yoke for the field magnet, a motor shaft, a drive pinion assembly on the motor shaft movable between active and rest positions thereon, a male conical surface on the drive pinion assembly, a member providing an operative connection between the solenoid and the pinion, a casing forming a nose portion, and a plate-like member sandwiched and forming a seal between the nose portion on the one hand and the solenoid housing and yoke on the other hand, the plate-like member having a concial depression with an opening at the bottom thereof through which the motor shaft passes, the male conical surface on the drive pinion assembly fitting into this recess when the drive pinion assembly is in its rest position.

13. An electric starter according to claim 12 wherein the said member has a coating to facilitate forming the said seal.

* * * * *